US007382212B2

(12) United States Patent
Lo Hine Tong et al.

(10) Patent No.: US 7,382,212 B2
(45) Date of Patent: Jun. 3, 2008

(54) TRANSITION BETWEEN A RECTANGULAR WAVEGUIDE AND A MICROSTRIP LINE COMPRISED OF A SINGLE METALLIZED BAR

(75) Inventors: Dominique Lo Hine Tong, Rennes (FR); Ali Louzir, Rennes (FR); Christian Person, Locmaria Plouzane (FR); Jean-Philippe Coupez, Le Relecq Kerhuon (FR)

(73) Assignee: Thomson Licensing, Boulogne-Billancourt (FR)

( * ) Notice: Subject to any disclaimer, the term of this patent is extended or adjusted under 35 U.S.C. 154(b) by 129 days.

(21) Appl. No.: 10/540,642

(22) PCT Filed: Dec. 22, 2003

(86) PCT No.: PCT/FR03/50201

§ 371 (c)(1),
(2), (4) Date: Mar. 3, 2006

(87) PCT Pub. No.: WO2004/066432

PCT Pub. Date: Aug. 5, 2004

(65) Prior Publication Data

US 2006/0152298 A1 Jul. 13, 2006

(30) Foreign Application Priority Data

Jan. 3, 2003 (FR) ..... 03 00045

(51) Int. Cl.
*H01P 5/107* (2006.01)

(52) U.S. Cl. ..... 333/26; 333/34; 29/600

(58) Field of Classification Search ..... 333/26, 333/34; 29/600
See application file for complete search history.

(56) References Cited

U.S. PATENT DOCUMENTS 2,897,461 A 7/1959 Ashbaugh et al.
3,265,995 A * 8/1966 Hamasaki ..... 333/21 R
3,932,823 A 1/1976 Lavedan, Jr. et al.

(Continued)

FOREIGN PATENT DOCUMENTS

EP 0458364 11/1991

(Continued)

OTHER PUBLICATIONS

"A Transition from Microstrip to Dielectric-filled Rectangular Waveguide in surface Mounting"; Sano et al; 2002 IEEE MTT-S Digest, Jun. 2002; pp. 813-816.*

(Continued)

*Primary Examiner*—Benny Lee
(74) *Attorney, Agent, or Firm*—Joseph J. Laks; Robert D. Shedd; Brian J. Cromarty

(57) ABSTRACT

The transition between a rectangular waveguide and a microstrip line consists of a ribbed rectangular waveguide realised in a foam bar in synthetic material of which the metallized base under the rib continues in the form of a foam plate constituting a substrate for the microstrip line, the rib having a base extending between the upper plane of the ribbed waveguide and the upper plane of the substrate and the microstrip line being disposed on the upper plane of the substrate in the continuation of the base of the rib.

6 Claims, 1 Drawing Sheet

U.S. PATENT DOCUMENTS 6,242,984 B1 * 6/2001 Stones et al. ..... 330/295
6,265,950 B1 7/2001 Schmidt et al.

FOREIGN PATENT DOCUMENTS

JP 5-335816 12/1993

OTHER PUBLICATIONS

Patent Abstracts of Japan, vol. 018, No. 161, Mar. 17, 1994 & JP 05-335816 (Japan Radio Co. Ltd. Dec. 17, 1993 See REF AE.

Search Report dated Jun. 9, 2004.

* cited by examiner

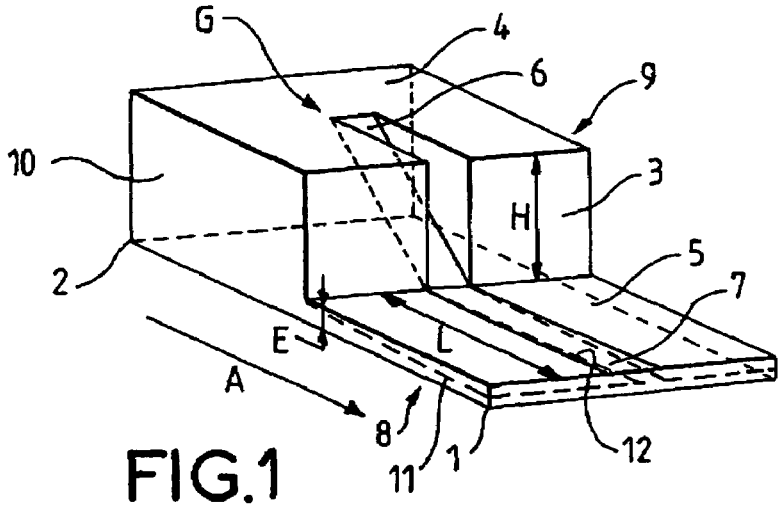
FIG.1
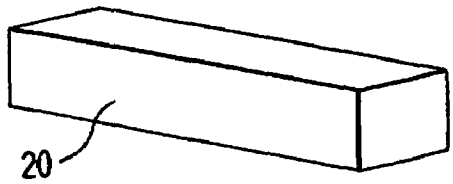
FIG.2
FIG.3
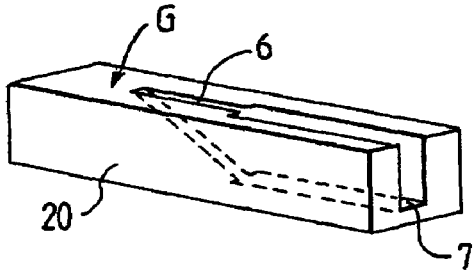
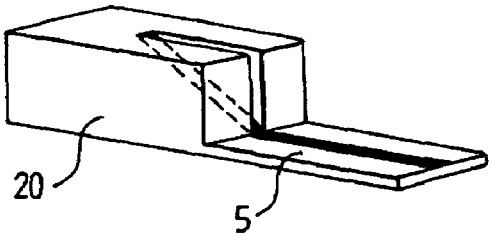
FIG.4

TRANSITION BETWEEN A RECTANGULAR WAVEGUIDE AND A MICROSTRIP LINE COMPRISED OF A SINGLE METALLIZED BAR

This application claims the benefit, under 35 U.S.C. § 365 of International Application PCT/FR03/50201, filed Dec. 22, 2003 which was published in accordance with PCT Article 21(2) on Aug. 5, 2004 in French and which claims the benefit of French patent application No. 0300045, filed Jan. 3, 2003.

FIELD OF THE INVENTION

The invention relates to a transition between a rectangular waveguide and a microstrip line. Waveguide structures are often well adapted for the realization of small loss and high performance passive functions (antenna source such as corrugated horn antennas, polarizers, filters, diplexers) more particularly at very high frequencies (centimetric and millimetric bands). As for the planar structures, they are very well suited for the low cost, high volume production of devices integrating passive and active functions using the methods for manufacturing standard printed circuits for frequencies that can reach the millimetric bands. For example, in a satellite front-end, the aerial feed, the filter and the polarizer, if there is one, are fairly frequently realized in waveguide technology while the rest of the signal processing functions (low noise amplification, mixing and intermediate filtering) are realized by standard printed circuit technology.

BACKGROUND OF THE INVENTION

The European patent no. 0350324 describes a transition between a waveguide structure and a microstrip transmission line according to which a conducting line is supported within the waveguide perpendicular to its axis and the microstrip transmission line extends transversally through the wall of the waveguide in a position producing a coupling of energy between the microstrip transmission line and the conducting line.

The document IEEE—1995—CESLT—page 1502—"An improved approach to implement a microstrip to waveguide transition"—G. Zarba, G. Bertin, L. Accatino, P. Besso—describes a transition between a ribbed waveguide and a microstrip line arranged on a substrate. In the embodiment described, the substrate is slid under the ribbed part of the waveguide to provide it with good mechanical stability and easy assembly.

The document IEEE Proceedings of APMC 2001, Taipei, Taiwan, ROC—page 543—"A broadband Microstrip to Waveguide Transition using Planar Technique"—describes a Ka band (26-40 GHz) transition that is obtained by inserting the microwave substrate, on which a tapered microstrip line is engraved, into a rectangular waveguide partially filled with a dielectric to ensure contact-free transition with the hot conductor of the microstrip line.

The document IEEE MICROWAVE AND WIRELESS COMPONENTS LETTERS, Vol. 11, No. 2, February 2001—page 68—"Integrated Microstrip and Rectangular Waveguide in Planar Form"—Dominique Deslandes and Ke Wu—Cheg-Jung Lee, Hsien-Shun Wu & Ching-Kuang C. Tzuang—presents a planar version of a Ka band transition (25-31 GHz). A guided structure is realised on a microwave substrate. The rectangular waveguide is realized by a double side metallization of the microwave substrate associated with metallized holes to realise the lateral faces of the rectangular waveguide.

These embodiments of a transition between a waveguide structure and a planar structure prove to be relatively complex to realize and require the assembly of several parts that must be all the more accurate as the operating frequencies are high. Moreover, they require microwave substrates of good quality to prevent the dielectric losses but for which the cost is high.

BRIEF SUMMARY OF THE INVENTION

The purpose of the invention is to propose a transition between a rectangular waveguide and a microstrip line that can be manufactured at low cost without assembling several parts.

According to the invention, the transition is characterized in that it consists of a ribbed rectangular waveguide realized in bar of synthetic material whose metallized base under the rib extends in the form of a foam plate of a synthetic material constituting a substrate for the microstrip line, the rib having a base extending between the upper plane of the ribbed waveguide and the upper plane of the substrate and the microstrip line being disposed on the upper plane of the substrate in the extension of the base of the rib.

According to the particularities of the transition according to the invention:

the base of the rib has a linear profile.

the foam plate constituting the substrate has a thickness that varies according to a longitudinal direction to modify the width of the microstrip line while maintaining its characteristic impedance almost constant.

the synthetic material is a dielectric foam presenting electrical characteristics approaching those of air, and the foam is a polymethacrylimide foam.

Other characteristics and advantages of the invention will emerge more clearly upon reading the following description illustrated by the drawings.

BRIEF DESCRIPTION OF THE DRAWINGS

FIG. 1 shows a functional diagram of a transition according to the invention between a rectangular waveguide and a microstrip line.

FIGS. 2 to 4 show the process for producing a transition according to the invention.

DETAILED DESCRIPTION OF THE INVENTION

In FIG. 1, a transition between a rectangular waveguide and a microstrip line is constituted by a ribbed rectangular waveguide guide G realised in a foam bar of synthetic material that is also used as a substrate for the microstrip line.

As can be seen in FIG. 1, the foam bar of synthetic material, for example a polymethacrylate imide foam known for its electrical characteristics approaching those of air, for its mechanical characteristics of rigidity and lightness and for its low cost price, extends according to a longitudinal direction A between two extremities 1, 2 between which a shoulder 3 is formed that extends perpendicularly to the longitudinal direction A. This shoulder 3 defines an upper plane 4 of the ribbed waveguide and an upper plane 5 of the substrate. The upper plane 5 of the substrate is shifted perpendicular to the longitudinal direction of the bar of height H in relation to the upper plane 4 of the ribbed waveguide, the height H corresponding to the height of the rib of the ribbed waveguide.

The base of the rib 6 of the waveguide G extends between the upper plane 4 of the waveguide and the upper plane 5 of the substrate via the shoulder 3. The base and the lateral walls of the rib 6 are metallized, the metallization of the base of the rib 6 continuing on the upper plane 5 of the substrate to constitute the microstrip line 7.

The metallized base 8 of the ribbed waveguide that extends under the rib 6 therefore continues in the form of a foam plate constituting the substrate for the microstrip line. This metallized base is therefore used as a ground plane for the microstrip 7.

The lateral faces 9 and 10 of the foam bar defining the ribbed rectangular waveguide are also metallized up to the limit of the shoulder 3 although the metallization of the lateral sides of the plate constituting the substrate of the microstrip line cannot degrade the electrical behaviour of the microstrip line.

As shown in FIG. 1, the base of the rib 6, at the junction with the microstrip line 7, is at a distance E from the ground plane of the microstrip line. This distance E corresponding to the thickness of the substrate at the junction with the ribbed waveguide.

In FIG. 1, the base of the rib 6 has a linear profile that enables it to be realised simply by machining, stamping, hot press moulding or by cutting the foam bar.

The rib 6 is centered in the width of the foam bar and its dimensions can be adjusted according to the operating frequency range required by ensuring an adequate gradual passage from the quasi-TEM propagation mode of the microstrip line to the fundamental mode of the guide. Such a gradual passage is obtained according to a given profile, linear, exponential or other. In general, the minimum length of the profile obtained to ensure correct matching over the entire operating range must be in the order of a fraction of the wavelength (for example, a quarter of the wavelength) corresponding to the lowest frequency.

At the junction of the base of the rib 6, the microstrip line 7 can have a width identical to or greater than that of the rib but it is fully known that the width of a microstrip line depends on the thickness of the substrate on which it is disposed as well as its permittivity. Hence, it is possible to adjust the height of the substrate in the junction plane to obtain a width identical or as close as possible to that of the rib. Then, to return to the most suitable thickness of substrate, for the microstrip line 7, it is sufficient to gradually vary the thickness of the foam plate constituting the substrate according to the longitudinal direction A. This variation in thickness is made at quasi-constant characteristic impedance by simultaneously modifying the width of the microstrip line which prevents using quarter wavelength type impedance transformers of the discontinuous variation line width which are the source of degradations in performance (losses, reduction in bandwidth). In FIG. 1, the impedance matching of the microstrip line is illustrated by a continuous linear reduction (shown as the dotted lines of 11) of the thickness of the substrate according to the direction A and by a continuous linear reduction (shown as the dotted lines of 12) of the width of the microstrip line over a certain length L of the microstrip line.

FIGS. 2 to 4 illustrate a method of producing the transition according to the invention in foam technology. A foam bar 20 is previously given a rectangular form in a transversal cross-section with dimensions that correspond to the inner dimensions of a rectangular waveguide for an operation that is theoretically monomodal in the frequency range required. Then, the foam bar is worked by machining, thermoforming, stamping or other methods to form the rib 6, as shown in FIG. 3. The operation of delimiting the rib 6 in the section of the waveguide G can be prolonged at the level of the section of the microstrip line 7, as shown in FIG. 3. The foam block 20 can then be fully metallized, the metallization of the rib and the formation of the microstrip line being obtained simultaneously. A non-directive metallization by projection or brush can be used. Then the foam block is cut transversally at the extremity of the rib 6 to obtain the substrate 5 (see FIG. 4) in plate shape of the microstrip line.

The transition according to the invention is therefore realized in a single part by using a material of low permittivity, generating low losses and having a good mechanical strength, which contributes to obtaining a microstrip line, the dimensions of which are in agreement with those of the waveguide section. Moreover, the realization of the transition according to the invention enables an electrical and physical continuity to be obtained between the waveguide and the microstrip without having recourse to impedance transformers of the line width discontinuous change type.

The invention claimed is:

1. A transition between a waveguide and a microstrip line, consisting of a single bar of synthetic material comprising a first part with metallized lateral faces to form a waveguide and a second part extending from the first part, said second part forming a substrate for a microstrip line, said bar presenting, at a level of transition between the first part and the second part, a shoulder defining an upper plane of the waveguide forming part and an upper plane of the second part forming the substrate for the microstrip line, and comprising between the two upper planes a rib having a metallized base and walls, the metallization of the base continuing by the microstrip line realized on the second part forming a substrate, the base common to the first and second parts being fully metallized.

2. The transition according to claim 1, wherein the base of the rib has a linear profile.

3. The transition according to claim 1, wherein the second part forming the substrate for a microstrip line has a thickness that varies in the direction extending from the first part and the width of the microstrip line is modified so that the characteristic impedance is maintained constant.

4. The transition according to one of claim 1, wherein the synthetic material is a dielectric foam.

5. The transition according to claim 4, wherein the foam is a polymethacrylate imide foam.

6. A method of producing a transition between a waveguide and a microstrip line comprising the step of:

working a foam bar to obtain a rectangular form in a transversal cross section with dimensions corresponding to the inner dimensions of a rectangular waveguide;

delimiting a rib in a section of the waveguide, said rib extending in a section receiving the microstrip;

fully metallizing the foam bar; and cutting transversally the foam bar at the extremity of the rib to obtain the substrate of the microstrip line.

* * * * *